US010718515B2

(12) United States Patent
Radway et al.

(10) Patent No.: US 10,718,515 B2
(45) Date of Patent: Jul. 21, 2020

(54) CONTROL OF COMBUSTION SYSTEM EMISSIONS

(71) Applicant: ENERCHEM INCORPORATED, Cincinnati, OH (US)

(72) Inventors: Jerrold E. Radway, Acworth, GA (US); James Smith, Fort Wayne, IN (US)

(73) Assignee: EnerChem Incorporated, Cincinnati, OH (US)

( * ) Notice: Subject to any disclaimer, the term of this patent is extended or adjusted under 35 U.S.C. 154(b) by 334 days.

(21) Appl. No.: 15/368,596

(22) Filed: Dec. 3, 2016

(65) Prior Publication Data

US 2017/0241641 A1 Aug. 24, 2017

Related U.S. Application Data

(60) Provisional application No. 62/263,508, filed on Dec. 4, 2015, provisional application No. 62/322,144, filed on Apr. 13, 2016, provisional application No. 62/374,584, filed on Aug. 12, 2016.

(51) Int. Cl.

| | |
|---|---|
| ***F23J 15/00*** | (2006.01) |
| ***F23J 7/00*** | (2006.01) |
| ***F23J 15/02*** | (2006.01) |

(52) U.S. Cl.

CPC ..... *F23J 15/003* (2013.01); *F23J 7/00* (2013.01); *F23J 15/02* (2013.01); *F23J 2215/10* (2013.01); *F23J 2215/20* (2013.01); *F23J 2215/60* (2013.01)

(58) Field of Classification Search

CPC .... F23J 15/003; F23J 15/02; F23J 7/00; F23J 2215/60; F23J 2215/20; F23J 2215/10

See application file for complete search history.

(56) References Cited

U.S. PATENT DOCUMENTS

| | | | | |
|---|---|---|---|---|
| 6,135,371 | A * | 10/2000 | Csendes | B01D 53/00 241/15 |
| 7,507,083 | B2 | 3/2009 | Comrie | |
| 7,674,442 | B2 | 3/2010 | Comrie | |
| 7,758,827 | B2 | 7/2010 | Comrie | |
| 7,776,301 | B2 | 8/2010 | Comrie | |
| 7,906,086 | B2 | 3/2011 | Comrie | |

(Continued)

*Primary Examiner* — David J Laux

(74) *Attorney, Agent, or Firm* — Meunier Carlin & Curfman LLC

(57) ABSTRACT

A process for capturing undesirable combustion products produced in a high temperature combustion system in which a carbonaceous fuel is utilized. Very finely sized particles of alkaline earth carbonates or hydroxides, with or without added ground ash, are provided in slurry form, are dried and milled to provide unagglomerated, sub-micron-sized particles that are injected along with pulverized coal and an oxidizing agent into the high temperature combustion zone of a furnace. The particles capture and neutralize the gases that result in condensable acids, including $SO_x$, $NO_x$, HCL, and HF, as well as capturing toxic metals that are present in the combustion products, they mitigate ash fouling and slagging, and they facilitate economic heat exchange that permits fuel savings and recovery of water for use in other processes.

7 Claims, 1 Drawing Sheet

(56) References Cited

U.S. PATENT DOCUMENTS

| | | | | |
|---|---|---|---|---|
| 7,955,577 | B2 | 6/2011 | Comrie | |
| 7,988,939 | B2 | 8/2011 | Comrie | |
| 7,993,616 | B2 | 8/2011 | Comrie | |
| 8,105,558 | B2 | 1/2012 | Comrie | |
| 8,114,368 | B2 | 2/2012 | Comrie | |
| 8,150,776 | B2 | 4/2012 | Comrie | |
| 8,226,913 | B2 | 7/2012 | Comrie | |
| 8,246,727 | B2 | 8/2012 | Comrie | |
| 8,313,323 | B2 | 11/2012 | Comne | |
| 8,367,025 | B2 | 2/2013 | Comrie | |
| 8,501,128 | B2 | 8/2013 | Comrie | |
| 8,506,916 | B2 | 8/2013 | Comrie | |
| 8,545,778 | B2 | 10/2013 | Comrie | |
| 8,574,324 | B2 | 11/2013 | Comrie et al. | |
| 8,658,115 | B2 | 2/2014 | Comrie | |
| 8,663,594 | B2 * | 3/2014 | Kawamura | B01D 53/1456 423/210 |
| 8,695,516 | B2 * | 4/2014 | Nijhawan | B01D 53/83 110/345 |
| 8,703,081 | B2 | 4/2014 | Comrie | |
| 8,807,055 | B2 * | 8/2014 | Radway | B01D 53/505 110/203 |
| 8,920,158 | B2 | 12/2014 | Comrie | |
| 9,133,408 | B2 | 9/2015 | Comrie et al. | |
| 9,169,453 | B2 | 10/2015 | Comrie | |
| 9,278,311 | B2 * | 3/2016 | Radway | B01D 53/60 |
| 9,416,967 | B2 | 8/2016 | Comrie | |
| 9,702,554 | B2 | 7/2017 | Comrie | |
| 9,822,973 | B2 | 11/2017 | Comrie | |
| 9,945,557 | B2 | 4/2018 | Comrie | |
| 2016/0221872 | A1 * | 8/2016 | D'Amico | C04B 7/4407 |
| 2016/0238244 | A1 * | 8/2016 | Schroter | F23J 15/02 |

* cited by examiner

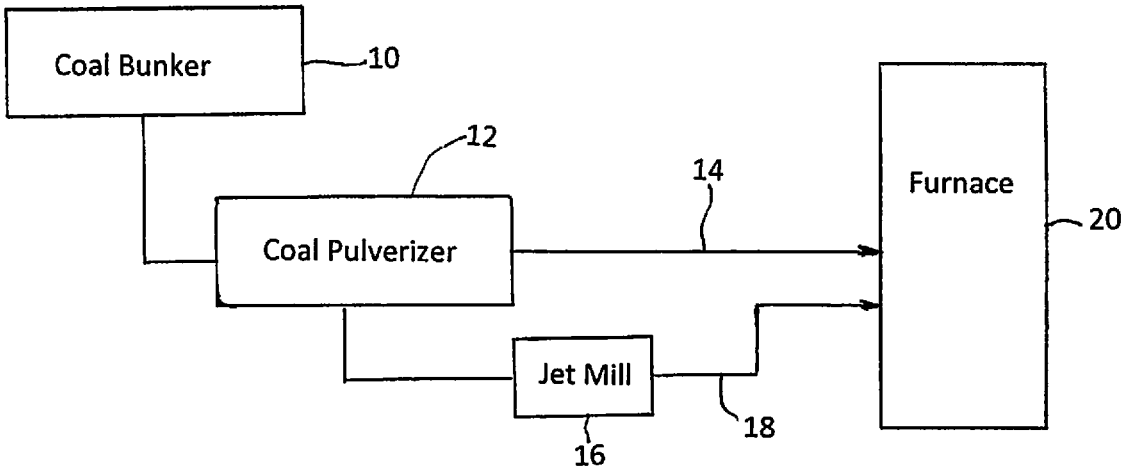
Coal Bunker
10
12
Coal Pulverizer
14
Furnace
20
Jet Mill
16
18

CONTROL OF COMBUSTION SYSTEM EMISSIONS

CROSS-REFERENCE TO RELATED APPLICATIONS

This application claims priority from U.S. Provisional Application Ser. No. 62/263,508, filed on Dec. 4, 2015, from U.S. Provisional Application Ser. No. 62/322,144, filed on Apr. 13, 2016, and from U.S. Provisional Application Ser. No. 62/374,584, filed on Aug. 12, 2016, the entire contents of each of which applications are hereby incorporated by reference herein to the same extent as if fully rewritten.

BACKGROUND OF THE INVENTION

Field of the Invention

The present invention relates to an improved process for capturing pollutants that are the result of the combustion in furnaces of pollutant releasing fuels such as coal, trash, and residual oil, particularly combustion carried out in boilers associated with steam produced for use in electricity generating stations or in industrial processing operations.

Description of the Related Art

Various processes have been disclosed for capturing undesirable pollutants resulting from the combustion of fuels. Some of those processes include the introduction into the furnace, at various locations within the furnace, of sorbents of various types, including alkaline-earth-metal-based compounds. Also previously known is a process in which the alkalinity of normal coarse fly ash is utilized and is partially effective in dealing with condensable acids, which enables a small reduction in flue gas exit temperature, with an accompanying gain in fuel thermal efficiency. However, that process permits capture of only a fraction of the pollutants and provides only about one fifth of the potential gain from a reduction of the flue gas exit temperature. In that regard, normal coarse fly ash includes only a minor fraction of the desirable micron-sized fly ash particles.

SUMMARY OF THE INVENTION

Briefly stated, in accordance with one aspect of the present invention, a process is disclosed for improved and more economical capture of undesirable pollutants that result from fuel combustion in boilers associated with electricity generating stations. The process builds on the prior art technology involving the introduction into the combustion zone within the high temperature region of the furnace of a sorbent in the form of an alkaline-earth-metal-based compound in particulate form, in the furnace region within which the temperatures are in the range of from about 1090° C. to about 1260° C. to provide calcined particles. The calcined alkaline-earth-metal-based compound results in particles that are of micron and sub-micron size for capturing $SO_x$ and other pollutants.

However, a significant enhancement of the process economics achievable with the alkaline-earth-metal-based compounds can be realized either by supplementing or completely replacing them with a minor fraction of micronized coal particles that are introduced into the furnace combustion zone in a range of from about 0.5% to about 15% by weight of a coal fuel, along with the main fuel supply in the form of pulverized coal particles that also include coal ash. Alternatively, a similar fraction of the coal ash could be micronized independently, but with some difficulty due to the fused nature of the ash, and then injected into the combustion zone. Since some of the ash components tend to be less effective scavengers of $SO_2$ than the alkaline earths, but react readily with $SO_3$, the process can be made more efficient by also introducing oxidizing agents into the combustion zone. Oxidants such as $CaBr_2$, can be introduced either directly onto the surface of the coal before the coal is fed into the combustion zone, or the oxidants, which can include ozone from a gaseous generator or from peroxide solutions, can be introduced separately. Furthermore, an oxidant such as $CaBr_2$ can be combined with an alkaline-earth-metal-based sorbent for effective oxidation of $SO_2$. Additionally, hydrogen peroxide can be introduced into the cooler regions of the system after the economizers. Both the use of oxidants and micronizing of the fuel into very fine particulates will also help with the control of $NO_x$

BRIEF DESCRIPTION OF THE DRAWING

FIG. 1 is a flow chart showing the arrangement of the several apparatus components for carrying out the present invention.

DESCRIPTION OF THE PREFERRED EMBODIMENTS

The processes herein disclosed relate to the capture of undesirable pollutants that result as products of the fossil fuel combustion process, particularly in coal-fired combustion systems such as those employed in industrial operations or in electrical power generating stations. Among the pollutants that are more effectively captured as a result of practicing the processes of the present invention are $SO_2$, $SO_3$, HCl, and toxic metals, such as mercury, selenium, lead, and arsenic. The present processes also relate to reducing the overall amount of $CO_2$ released in the course of capturing the other pollutants.

The notion of introducing a sorbent into a fossil fuel combustion zone for controlling the volume of emissions of pollutants resulting from the combustion process is described in at least the following U.S. patents and pending patent application, the entire contents of each of which is hereby incorporated by reference to the same extent as if fully rewritten:

- U.S. Pat. No. 6,997,119 B2, issued on Feb. 14, 2006, entitled "Combustion Emissions Control and Utilization of Byproducts";
- U.S. Pat. No. 7,276,217 B2, issued on Oct. 2, 2007, entitled "Reduction of Coal-Fired Combustion Emissions";
- U.S. Pat. No. 7,971,540 B2, issued on Jul. 5, 2011, entitled "Control of Combustion System Emissions";
- U.S. Pat. No. 8,807,055 B2, issued on Aug. 19, 2014, entitled "Control of Combustion System Emissions"; and
- U.S. Pat. No. 9,278,311 B2, issued on Mar. 8, 2016, entitled "Control of Combustion System Emissions."

The present invention is directed to an improved process for capturing combustion system pollutants that is a modification of processes that are disclosed in the patents identified above. In addition to the introduction into the furnace combustion zone of alkaline-earth-metal-based compounds that are transformed by the heat of combustion into alkaline-earth-metal oxides for capturing particular pollutants, the present invention involves taking advantage of the ash that is present in the coals that are utilized as the fuel for combustion, wherein the coal ash serves either as a supplemental source of pollutant sorbent, or as the entirety of the pollutant sorbent.

The amount of ash that is present in coal is dependent upon the type and geographical source of the coal—anthracitic coals can have from about 10% to about 20% by weight of coal ash, whereas bituminous coals can have from about 5% to about 10% by weight of coal ash. Coal ash is composed of several metallic oxides, including, but not limited to CaO, MgO, $Fe_2O_3$, $Al_2O_3$, $Na_2O$, $K_2O$, and various alkali compounds. Each of the CaO and MgO, which are the primary scavengers of the undesirable pollutants, is present in the coal ash in minor amounts, of the nature of from about 0.6% to about 6.0% by weight of the coal ash, but, again, the amounts are dependent upon the geographical source of the coal, whether of eastern U.S. origin or of western U.S. origin. The coal ash components other than CaO and MgO will react more readily with $SO_3$, than with $SO_2$, which means that the micronizing of the coal ash, with or without injecting oxidizing agents, operates to convert substantially all of the ash components, except $SiO_2$, to useful sorbents. Consequently, the micronization of only a small fraction of the coal ash is able to clean the flue gas of undesirable pollutants. Further, the micronization of the coal ash provides a large number of discrete particles, increasing the probability of contact of the coal ash sorbent particles with pollutant particles, capture of condensable acids that will allow increased cooling of the flue gases, thereby increasing the thermal efficiency gain of the furnace by 6 or 7 times over previous arrangements. The substitution of coarse fly with micronized ash will also have a positive impact on ash deposition Typically, coal is supplied to a power generating station in the form of coal particles having a size of from about one-half inch to about 3 inches. Before their introduction into furnaces that serve for steam generation, the coal particles undergo particle size reduction in coal pulverizers that reduce the particle size to from about −200 mesh to a median size of about −325 mesh. The reduced-size coal particles are then conveyed from the coal pulverizer and injected into the combustion zone along with a sufficient quantity of air to form a combustible fuel/air mixture that upon combustion provides the heat necessary to transform water into the steam that is utilized to drive steam turbines that, in turn, drive generators to provide electricity distribution into the electrical grid for consumption by industrial, commercial, and individual users.

FIG. 1 shows a flow chart indicating the flow path of coal supplied to a furnace for combustion. The incoming raw coal of relatively large particle size, from about one-half inch to about 3 inches in size, is conveyed from a coal bunker at the furnace site, and is introduced into a coal pulverizer to further reduce the coal particle size. After passage through the coal pulverizer, in which the coal particles are reduced to a median particle size of about −325 mesh, the reduced size coal particles from the coal pulverizer are conveyed directly to the furnace for introduction into the combustion region along with combustion air. As described in the patents identified above, the coal particles can be supplemented with an alkaline-earth-metal compound in particulate form (from about 0.07 to about 3 microns) to serve as a sorbent for capturing undesirable pollutants resulting from the combustion process.

Alternatively, in the present invention a second portion of the incoming coal, a bypass flow of coal particles, from about 1% to about 15% by weight of the coal that leaves the coal pulverizer, is conveyed to a jet mill or to a wet or dry grinder to further reduce the size of the incoming coal particles to from about 0.5 microns to about 3 microns. The resultant, further-reduced-size coal particles that exit the jet mill or wet grinder include coal ash having compounds that when combusted provide micron-size, high surface area mineral particles that serve to capture the $SO_2$ and $SO_3$ that are some of the combustion products of coal combustion and that is captured and transformed into sulfate particles, which can then be separated from the flue gas at a point downstream of the furnace and collected as useful products. The flash calcined coal-ash-containing particles include minerals that capture $SO_3$. In addition to the micronized minerals provided by the coal ash contained in the bypass flow of coal particles, the remaining flow of coal particles from the coal pulverizer includes all of the same mineral sorbents, but which are much coarser and less effective in scavenging pollutants.

The reduced-size oxide particles that result when the commercially micronized calcium or magnesium compounds are supplied as sorbents within the coal particle stream, as well as the bypass flow of similarly size-reduced coal and coal ash particles, are injected into the burner region of the furnace they can be of a particle size of from about 0.07 microns to about 3 microns, preferably about 0.5 microns (500 nanometers) and finer. Note that when not combined with the coal, the commercially micronized calcium or magnesium compounds and the micronized coal ash can also be introduced into other regions of the furnace, or in convection sections.

The external surface area of an about 0.5 micron median particle size reagent is about 40 to 88 times that of a commercially available −325 mesh (40 micron) limestone particle. The mineral particles in that preferred micron and sub-micron particle size results in about 61,000 to about 676,000 times as many sorbent particles per pound of material, as compared with the commercially available −325 mesh material. The result of the presence of such massive numbers of smaller mineral particles in the combustion zone of the furnace will be the capture of as much as or greater than 84% of the $SO_x$, and up to 90+% of toxic metals, at a stoichiometric ratio of Ca/S of the sulfur content of the fuel of only about 1.5 times, or less.

In FIG. 1, raw coal from a coal supply source, typically as coal particles having a size of from about one half inch to about three inches, more or less, is provided and is stored in a raw coal bunker 10 shown in FIG. 1. For gravity flow of the coal particles, coal bunker 10 can be connected in overlying relationship with a coal mill or pulverizer 12, that serves for reducing the size of the as-supplied raw coal to smaller sized coal particles, typically having a particle size of from about one millimeter to about 75 microns, more or less. If the coal is wet, addition to the coal of between about 2% to 5% by weight of a suitable flow agent can be provided without causing problems in moving the coal to the coal mill and to the burners. The amount of flow agent will vary with climate and season, but ordinary wet coal problems can be reduced to avoid excessive wetness of the coal when utilized with the sorbent flow agent disclosed herein. An example of a suitable flow agent is RAMsorb™ organic polymer, available from RAM-3 Combustion Technologies, 8765 West Market Street, Greensboro, N.C. 27409. The coal particles from the coal pulverizer 12 pass through conduit 14 for entry into the combustion region of furnace 20 along with combustion air to provide a fuel/air mixture for combustion.

The bypass path extends from coal pulverizer 12 to jet mill 16 and through bypass conduit 18 for introduction of micronized coal and/or micronized coal ash particles into the combustion region within furnace 20. Dryer/mills, both wet and dry media mills or jet mills suitable for use in the bypass path illustrated in FIG. 1 and referred to above are available from the Hosokawa Micron Powder Systems division of Hosokawa Micron Corporation, 10 Chatham Road, Summit, N.J. 07901, such as its Micron Drymeister flash dryer unit that combines drying, milling, and classifying in a single installation. Another source of suitable dryer/mills is the Fluid Energy Equipment Division of Fluid Energy Processing & Equipment Co., 4300 Bethlehem Pike, Telford, Pa. 18969, which markets Thermajet® flash drying processing units. An example of a type of jet mill that can be utilized is one having the structure described in U.S. Pat. No. 3,840,188, entitled "Fluid Energy Drying and Grinding Mill." Media Mills are also available from Union Process Company, located in Akron, Ohio In one exemplary embodiment of the sorbent addition system shown in FIG. 1, dried, reduced size, and deagglomerated sorbent particles of an alkaline-earth-metal of sub-micron size are intimately intermixed with the reduced size pulverized coal particles in coal mill 12, to be conveyed to the burner heads for introduction through the furnace wall directly into burner heads at the combustion zone of the furnace, and without the need to provide additional sorbent injection openings in the furnace wall.

Alternatively, in a second exemplary embodiment of the sorbent addition system dried, reduced size coal and coal ash particles are also provided through bypass conduit 18 to flow directly to the burner heads for introduction directly into the combustion zone, either to supplement the externally-supplied sorbent that is added to or supplied with the pulverized coal particles, or to completely replace the externally supplied sorbent in order to encourage direct contact with the combustion products that are to be captured within the furnace, of the sub-micron size sorbent particles included in the further reduced size coal.

The effectiveness of the micronized coal ash particles as a sorbent for improved emissions control can be further enhanced by the addition to the coal of oxidants, such as $CaBr_2$, provided in concentrations of under a few thousand ppm, in order to enhance the conversion of Hg to a scavengeable form. Additional improvements in emissions control can be achieved by the addition of $H_2O_2$ in the cooler, convection pass of the boiler, where the temperature is between about 1800° F. to about 2200° F., or later downstream, to help to convert both $SO_x$ and $NO_x$ to scavengable form.

Both pulverized coal particles conveyed along the direct pathway through conduit 14, and also the bypass flow of dried, further-size-reduced and deagglomerated coal and coal ash particles within bypass conduit 18 can be combined for introduction into the combustion region of the furnace. When so combined, the quantity of externally supplied alkaline-earth-based sorbent can be reduced because of the supplemental coal-ash-based mineral components contained in the coal ash, thereby reducing the need for a portion of the externally supplied sorbent.

As a further aspect of the present invention, the $CaBr_2$ oxidant, whether applied to the incoming coal or introduced separately and directly into the combustion zone, also serves to oxidize $SO_2$ to $SO_3$. And both the micronized sorbent and the micronized fly ash serve to capture $SO_3$ to convert it to a sulfate, such as $CaSO_4$. In that regard, the oxidant results in more of the micronized ash contributing to the acid gas scavenging in that the $Fe_2O_3$ and the $Al_2O_3$ components of the coal ash operate in addition to the CaO, MgO, and the traces of alkali metals present in the ash. By the improved scavenging of $SO_3$, the flue gas temperature at the exit from the boiler can be reduced, thereby enabling an increase in the power plant operating efficiency of the order of about 6% to about 8%. Further, significant amounts of water can be recovered for in-plant use or for sale. And the capture of the acid-causing gases allows the substitution of less costly materials for the condensing heat exchangers Additionally, by capturing pollutants, the micronized fly ash operates to minimize possible corrosive impact of the $CaBr_2$ and $H_2O_2$ oxidants, it allows adjusting the SCR so that it oxidizes more $SO_2$ to $SO_3$ that can be captured by the micronized fly ash from the micronized coal. It also serves to minimize negative impacts on electrostatic precipitator performance, while also providing incremental $NO_x$ reduction. In connection with $SO_2$ capture by $CaBr_2$, from about 2 to about 15% of micronized fly ash produced by the combustion of the coal and introduced into the scrubber, such as from a conventional powder classifier, can have the desired beneficial capture effect on the operation of that component of the system and can effectively provide a low cost sorbent for scrubber use. Moreover, the micronized ash can is useful as a free scrubbing reagent, and SCR-type devices can be used to oxidize the $SO_2$ by catalysis, in contrast to the chemical reactions provided by the $CaBr_2$ and the $H_2O_2$.

The concept of deploying oxidants to convert the $SO_2$ to $SO_3$ to enhance pollutant capture efficiency can also be used when the capital cost for micronizing the ash is not available. In fact, when $CaBr_2$ is the oxidant, both it and the sorbent-based scavenging agent can be applied directly onto the coal at a point before the coal mill, either as a powder or as a liquid blend, or the $CaBr_2$ can be introduced separately, either in powdered form or in solution. The quantity of oxidant utilized is based upon the sulfur content of the coal to be fired. It can range from as little as 0.5 of the stoichiometric amount to 3, 4, or more times the stoichiometric amount that would be needed to oxidize the chosen amount of sulfur to be captured. Similarly, the amount of alkaline sorbent will be from as low as 1 to as high as 4 times the stoichiometric amount for the anticipated amount of $SO_3$ that is generated by the oxidation.

When ash is the sorbent, the fraction micronized will be determined by the capacity of the micronizing equipment, the chemistry of the ash, and the economics and feasibility of the specific milling system that is employed. The dosage will be constrained by the specific milling system and the type and amount of coal, but the target dosage will fall into a similar range based upon the stoichiometric capacity of the ash, which will be based upon the ash components that are cited earlier herein. The $CaBr_2$ and the ozone can be effective when they are delivered in the high temperature combustion zone, but the $H_2O_2$ must be delivered into a cooler region of the system.

As earlier noted, a combination of an oxidant such as $CaBr_2$ with an alkaline-earth-metal-based sorbent and applied to coal is effective for oxidation of $SO_2$ to $SO_3$. The ratio of the bromide to the amount of $SO_2$ to be oxidized would be less than about 3 times the stoichiometric amount of $SO_2$ in the flue gas. Similarly, the amount of the scavenging sorbent mixed with a $CaBr_2$ oxidant solution and added to the fuel would be a function of the amount of $SO_2$ to be converted to $SO_3$.

Other sorbents suitable for oxidizing $SO_2$ and following gas-phase ozone exposure include mineral dusts found in the atmosphere and that include metal oxides such as MgO, $Al_2O_3$, $Fe_2O_3$, $TiO_2$, and $SiO_2$, as well as $CaCO_3$, China loess, and other suitably sized byproducts or waste materials.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A process for controlling combustion system emissions from combustion systems in which a carbonaceous-fuel is combusted, said process comprising the steps of:

introducing a carbonaceous fuel and air into a furnace to provide a combustible fuel/air mixture and combusting the fuel/air mixture at a furnace combustion region to provide combustion products in the form of flue gases containing pollutant compounds including $SO_x$, $NO_x$, Hg, As, and $CO_x$, wherein the temperature within the furnace combustion region is from about 2500° F. to about 3000° F.;

introducing into the furnace combustion region an alkaline-earth-metal-containing reagent to expose the reagent to the furnace combustion region temperature to thereby calcine the reagent within the furnace combustion region into a plurality of alkaline-earth-metal oxide particles to provide a scavenging agent in particulate form for scavenging combustion product components, wherein the alkaline-earth-metal oxide particles are in the form of a plurality of discrete, substantially non-agglomerated alkaline-earth-metal oxide particles having a particle size of less than about 3 microns;

introducing $CaBr_2$ into the furnace combustion region, wherein the $CaBr_2$ oxidizes $SO_2$ in the flue gases to $SO_3$;

contacting the alkaline-earth-metal oxide particles with the combustion products to react the alkaline-earth-metal oxide particles with pollutants contained in the combustion products to capture $SO_x$, $NO_x$, and toxic metals that are present in the combustion products, wherein the $SO_3$ is capture by the alkaline-earth-metal oxide particles; and transporting the flue gases and particles from the combustion region and through the furnace to a furnace exit.

2. The process of claim 1, wherein the alkaline-earth-metal metal oxide particles comprise CaO, MgO, or a combination thereof.

3. The process of claim 1, wherein the alkaline-earth-metal metal oxide particles have a particle size of from about 0.07 to about 3 microns.

4. The process of claim 3, wherein the alkaline-earth-metal metal oxide particles have a particle size of from about 0.07 to about 0.5 microns.

5. The process of claim 1, wherein introducing into the furnace combustion region the alkaline-earth-metal-containing reagent comprises:

intermixing the alkaline-earth-metal-containing reagent with the carbonaceous fuel to form a mixture comprising the alkaline-earth-metal-containing reagent and the carbonaceous fuel; and introducing the mixture comprising the alkaline-earth-metal-containing reagent and the carbonaceous fuel at the furnace combustion region.

6. The process of claim 5, wherein the carbonaceous fuel comprises coal and wherein the alkaline-earth-metal-containing reagent is intermixed with the carbonaceous fuel in a coal mill.

7. The process of claim 1, wherein the $CaBr_2$ is introduced into the furnace combustion region at from 0.5 times to 4 times a stoichiometric amount needed to oxidize the $SO_2$ in the flue gases.

* * * * *